US007716841B2

(12) United States Patent
Kang

(10) Patent No.: US 7,716,841 B2
(45) Date of Patent: May 18, 2010

(54) REMOVING TOOL FOR CAR-WINDOW EDGE STRIPS

(76) Inventor: Hsin Fa Kang, P.O. Box 90, Tainan City 70499 (TW)

( * ) Notice: Subject to any disclaimer, the term of this patent is extended or adjusted under 35 U.S.C. 154(b) by 120 days.

(21) Appl. No.: 11/947,799

(22) Filed: Nov. 30, 2007

(65) Prior Publication Data

US 2009/0139035 A1 Jun. 4, 2009

(51) Int. Cl.
*B26B 5/00* (2006.01)

(52) U.S. Cl. ..... 30/294; 30/314; 30/339; 30/340

(58) Field of Classification Search ..... 30/115, 30/294, 314, 339, 340
See application file for complete search history.

(56) References Cited

U.S. PATENT DOCUMENTS 3,372,459 A * 3/1968 Lambright ..... 156/344
3,448,517 A * 6/1969 Cothery ..... 30/140
3,924,327 A * 12/1975 Edwards ..... 30/277
4,481,059 A * 11/1984 Steck ..... 156/254
5,400,510 A * 3/1995 Glodowski ..... 30/164.9
5,622,093 A * 4/1997 Hutchins ..... 83/13
5,784,788 A * 7/1998 Cothery ..... 30/294
6,256,889 B1 * 7/2001 Zuro ..... 30/339
7,308,763 B2 * 12/2007 Glodowski ..... 30/294
7,596,871 B1 * 10/2009 Nilsson ..... 30/329

* cited by examiner

*Primary Examiner*—Hwei-Siu C Payer

(57) ABSTRACT

A removing tool for car-window edge strips includes a grip, a linking rod, a protective disc and a tool set. The protective disc is positioned between the grip and the linking rod, and the linking rod has a flat insert groove diametrically formed vertically for the tool set to insert therein and kept tight by screws. The protective disc can protect hands of a user from getting hurt during removing operation. The flat insert groove of the linking rod can be used for combining different tool sets for removing car-window edge strips and dried glue attached with the edge strips with convenience and quickness.

6 Claims, 6 Drawing Sheets

REMOVING TOOL FOR CAR-WINDOW EDGE STRIPS

BACKGROUND OF THE INVENTION

1. Field of the Invention

This invention relates to a removing tool for car-window edge strips, particularly to one convenient to use, possible to use different tool sets changeable, and quickly removing edge strips in the outer side of a car window.

2. Description of the Prior Art

Generally a car window is provided with an edge strip closely contacting the glass of the car window for preventing water from directly flowing into the door and also scraping off water drops off the glass in case of the glass is lowered down. However, dirt and water may accumulate in the gap between the edge strip and the glass over time, resulting in erosion and breakup of the edge strip after a certain period of use. Therefore, the edge strip sometimes has to be replaced with new one. At present, no special tools for removing the car-window edge strip, and a flat tool such as a flat-tip screwdriver is usually used for removing it. As the edge strip is closely contacting the glass, a worker without a time-tested experience may not be dexterous enough to do the work and hurt in plying off edge strips or harm the metal portion of a window. Even if edge strips are pried off, there remains dried glue in the edge, necessary to be taken off by a knife, resulting in potential cut in a worker's fingers or hand.

SUMMARY OF THE INVENTION

The purpose of the invention is to offer a removing tool for car-window edge strips.

The main feature of the invention includes a grip, a linking rod, a protective disc and a tool set. The grip is provided with a recessed chamber, and a female threaded hole formed in a lower portion of the recessed chamber. The linking rod is combined on the grip and provided with a post member at a lower portion thereof, a male threaded rod formed at a lower end of the post member to engage with the female threaded hole of the grip, a flat insert groove formed diametrically in a substantive portion of the linking rod and opening to an upper end, at least one through hole bored in a side of a wall of the linking rod and communicating with the flat insert groove, at least one threaded hole formed in an opposite side of the wall of the linking rod and corresponding to the at least one through hole and communicating with the flat insert groove, and at least one screw respectively passing through the at least one through hole and further engaging with the at least one threaded hole. The protective disc is positioned between the grip and the linking rod and provided with a center hole. The tool set is combined with the linking rod and has one end fitting in the flat insert groove of the linking rod. The tool set is provided with at least one through hole aligned to the at least one through hole of the linking rod and respectively engaged by the at least one screw of the linking rod.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
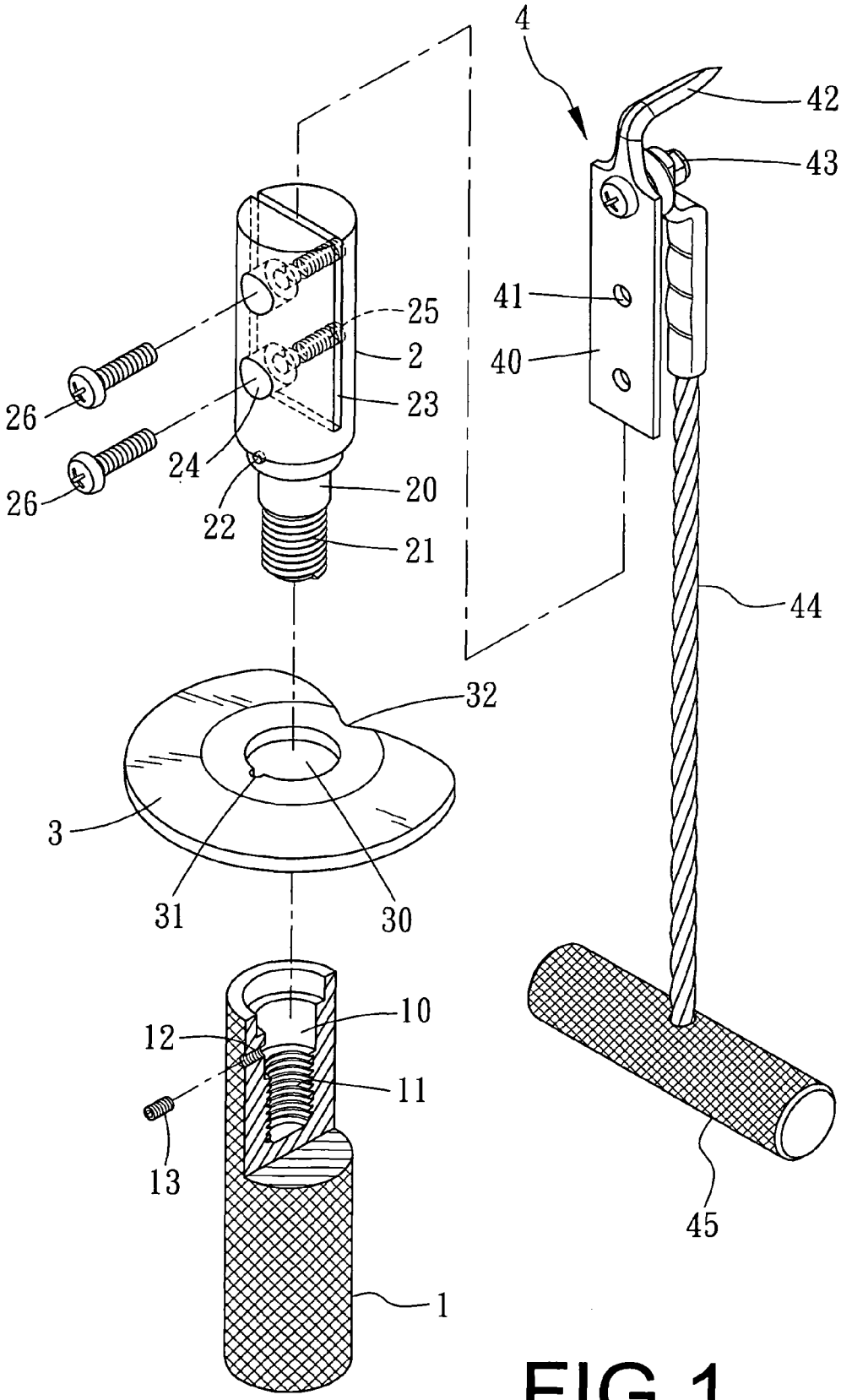
FIG. 1 is an exploded perspective view of a first preferred embodiment of a removing tool for car-window edge strips in the present invention.
Figure 2:
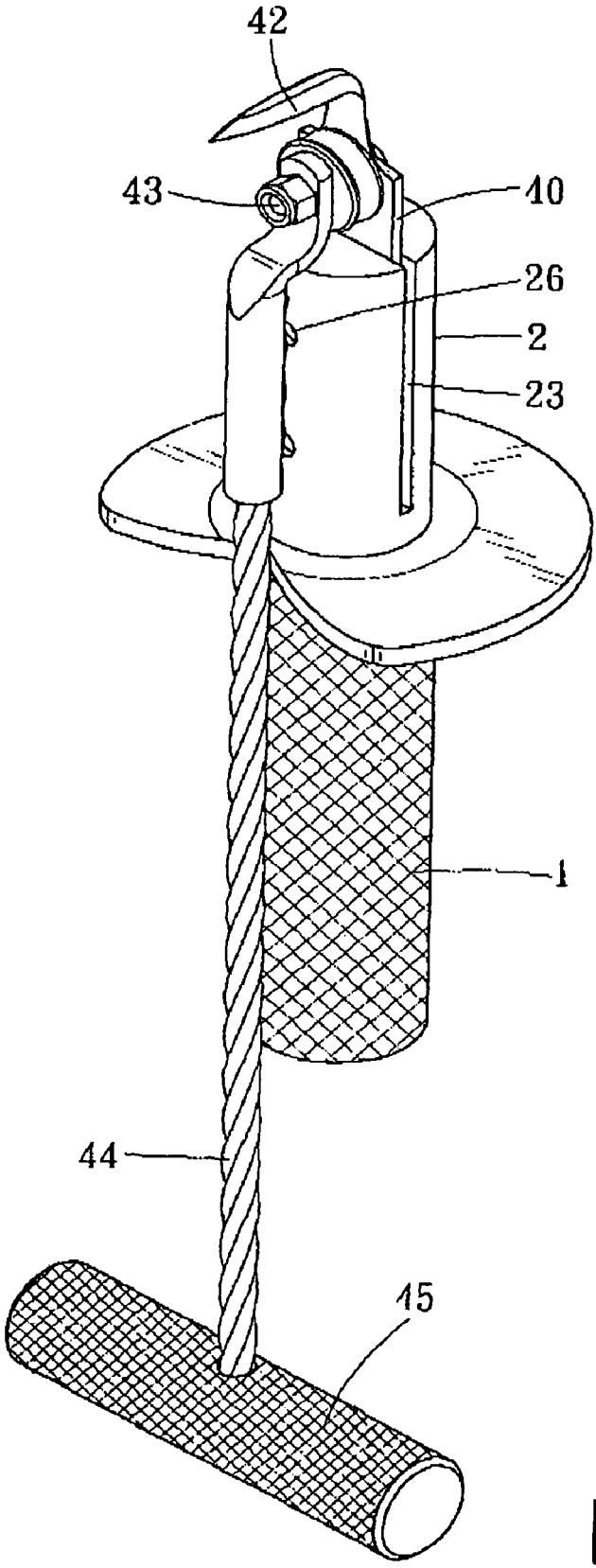
FIG. 2 is a perspective view of the first preferred embodiment of a removing tool for car-window edge strips in the present invention.

A first preferred embodiment of the present invention, as shown in FIGS. 1-2, includes a grip 1, a linking rod 2, a protective disc 3, and a tool set 4 as main components combined together.

The grip 1 is provided with a recessed chamber 10, a female threaded hole 11 formed in a lower portion of the recessed chamber 10, a threaded hole 12 formed near an upper portion of an outer wall of the grip 1, and a fixing pin 13 engaged in the threaded hole 12.

The linking rod 2 is positioned on the grip 1, having a post member 20 at a lower portion thereof, a male threaded rod 21 formed at a lower end of the post member 20 to engage with the female threaded hole 11 of the grip 1, a position ear 22 formed on an outer surface of the post member 20, a flat insert groove 23 formed diametrically in a substantial portion of the linking rod 2 and opening to an upper end, at least one through hole 24 bored in a side of a wall of the linking rod 2 and communicating with the flat insert groove 23, at least one threaded hole 25 bored in an opposite side of the wall of the linking rod 2 and corresponding to the at least one through hole 24 and communicating with the flat insert groove 23, and at least one screw 26 respectively passing through the at least one through hole 24 and further engaging with the at least one threaded hole 25.

The protective disc 3 is positioned between the grip 1 and the linking rod 2, having a center hole 30 for the post member 20 to pass through, a position notch 31 formed in a wall of the center hole 30 for the position ear 22 of the linking rod 2 to fit stably therein, and a shrunk edge 32 formed at one side thereof.

The tool set 4 capable of being a removing tool is combined with the linking rod 2, having one end provided with a flat plate member 40 fitting closely in the flat insert groove 23 of the linking rod 2, and the other end provided with a blade member 42 extending to bend approximate 90 degrees from an upper end of the flat plate member 40. At least one through hole 41 is bored in the flat plate member 40 and aligned with the at least one hole 24 of the linking rod 2 and respectively engaged by the at least one screw 26 of the linking rod 2. The tool set 4 also has one side pivotally connected to an auxiliary pull rod 44 by a pivot 43. The auxiliary pull rod 44 is made of a flexible material and provided with a handle 45 fixed at a lower end thereof.

Figure 3:
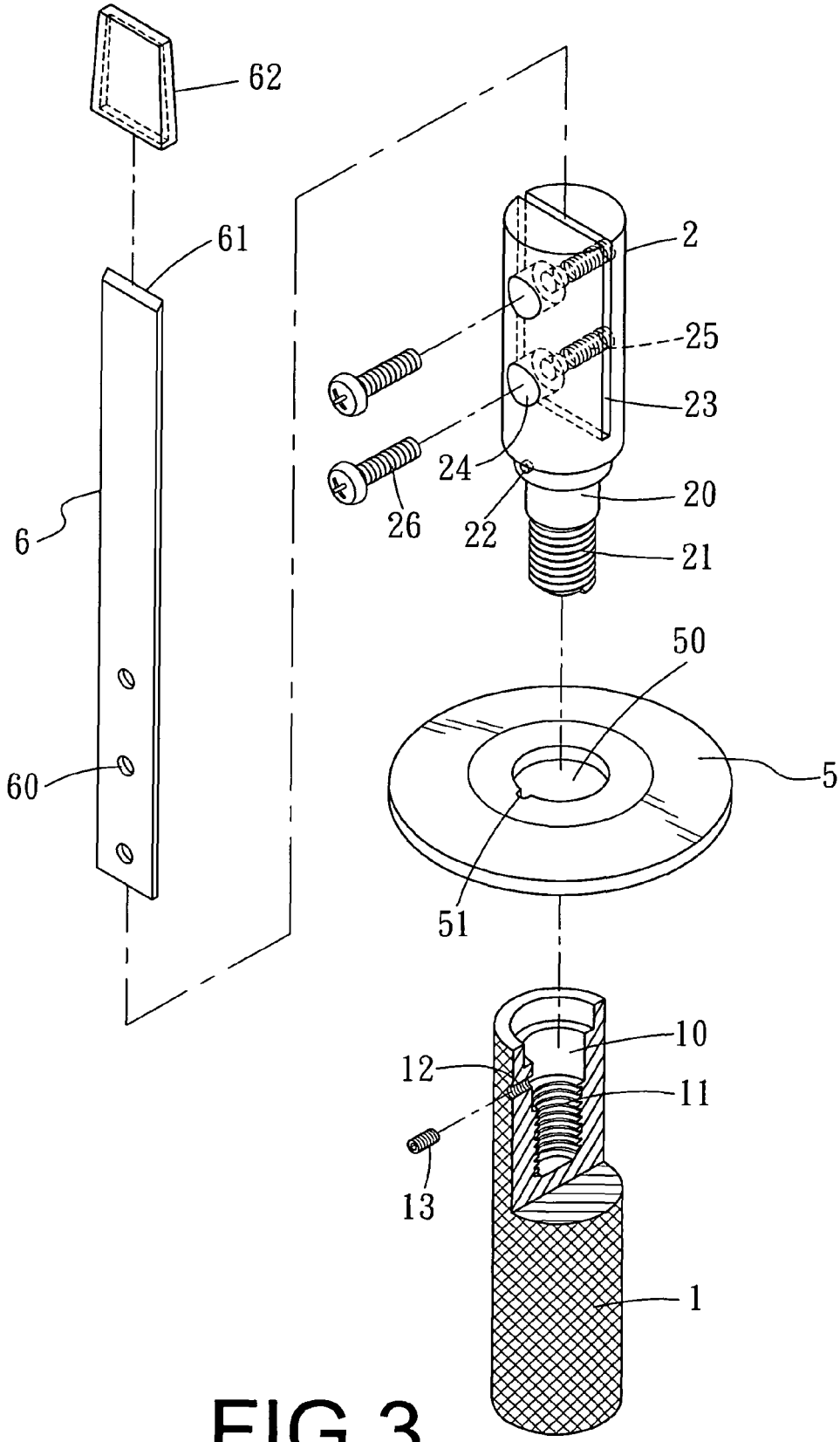
FIG. 3 is an exploded perspective view of a second preferred embodiment of a removing tool for car-window edge strips in the present invention.
Figure 4:
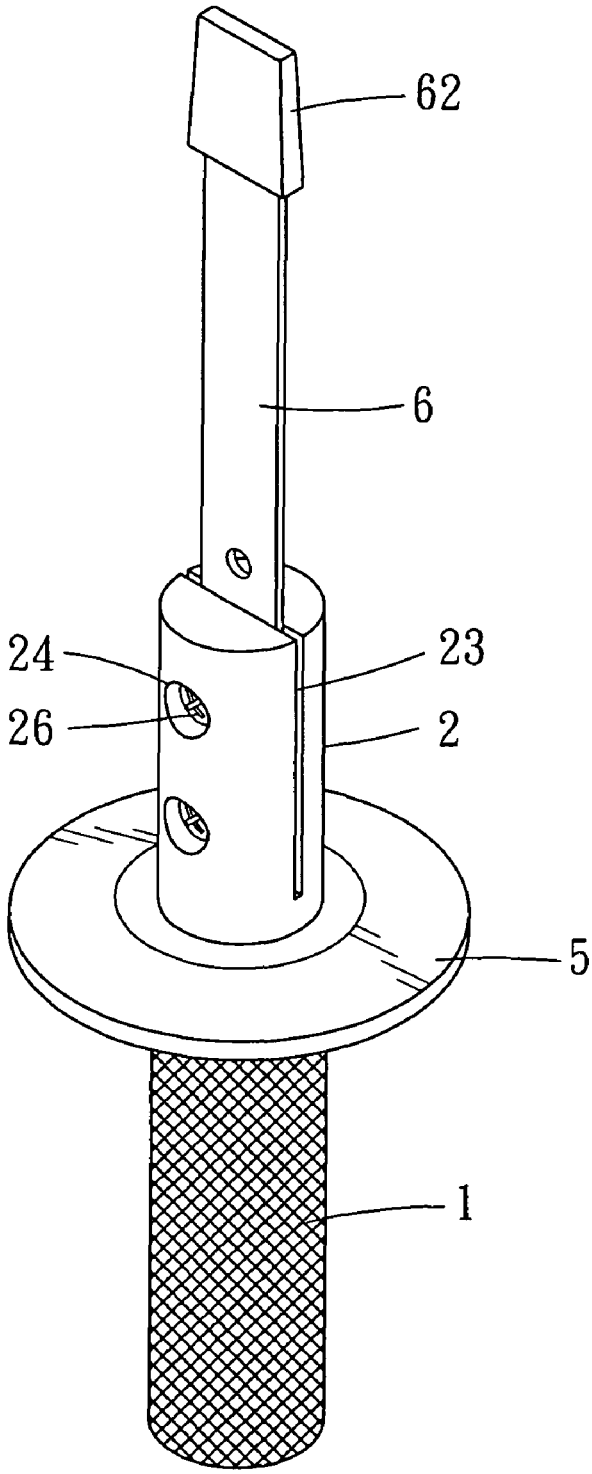
FIG. 4 is a perspective view of the second preferred embodiment of a removing tool for car-window edge strips in the present invention.

Next, a second preferred embodiment of a removing tool for car-window edge strips is shown in FIGS. 3 and 4, including a grip 1, a linking rod 2, a protective disc 5, a tool set 6 as main components combined together.

The grip 1, as that of the first embodiment, is provided with a recessed chamber 10, a female threaded hole 11 formed in a lower portion of the recessed chamber 10, a threaded hole 12 bored near an upper portion of an outer wall of the grip 1, and a fixing pin 13 engaged in the threaded hole 12.

The linking rod 2, as that of the first embodiment, is positioned on the grip 1, having a post member 20 at a lower portion thereof, a male threaded rod 21 formed at a lower end of the post member 20 to engage with the female threaded hole 11 of the grip 1, a position ear 22 formed on an outer surface of the post member 20, a flat insert groove 23 formed diametrically in a substantial portion of the linking rod 2 and opening to an upper end, at least one through hole 24 bored in a side of a wall of the linking rod 2 and communicating with the flat insert groove 23, at least one threaded hole 25 bored in an opposite side of the wall of the linking rod 2 and corresponding to the at least one through hole 24 and communicating with the flat insert groove 23, and at least one screw 26 respectively passing through the at least one through hole 24 and further engaging with the at least one threaded hole 25.

The protective disc 5 is positioned between the grip 1 and the linking rod 2, having a center hole 50 for the lower post member 20 to pass through, a position notch 51 bored in a wall of the center hole 50 for the position ear 22 of the linking rod 2 to fit stably therein.

The tool set 6 capable of being a scraping tool is combined with the linking rod 2, consisting of an elongate strip having one end fitting closely in the flat insert groove 23 of the linking rod 2 and the other end provided with a blade member 61 having a sloping surface. At least one through hole 60 is bored in the tool set 6 and aligned with the at least one hole 24 of the linking rod 2 and respectively engaged by the at least one screw 26 of the linking rod 2. A cover 62 is capable of closing around the blade member 61.

Figure 5:
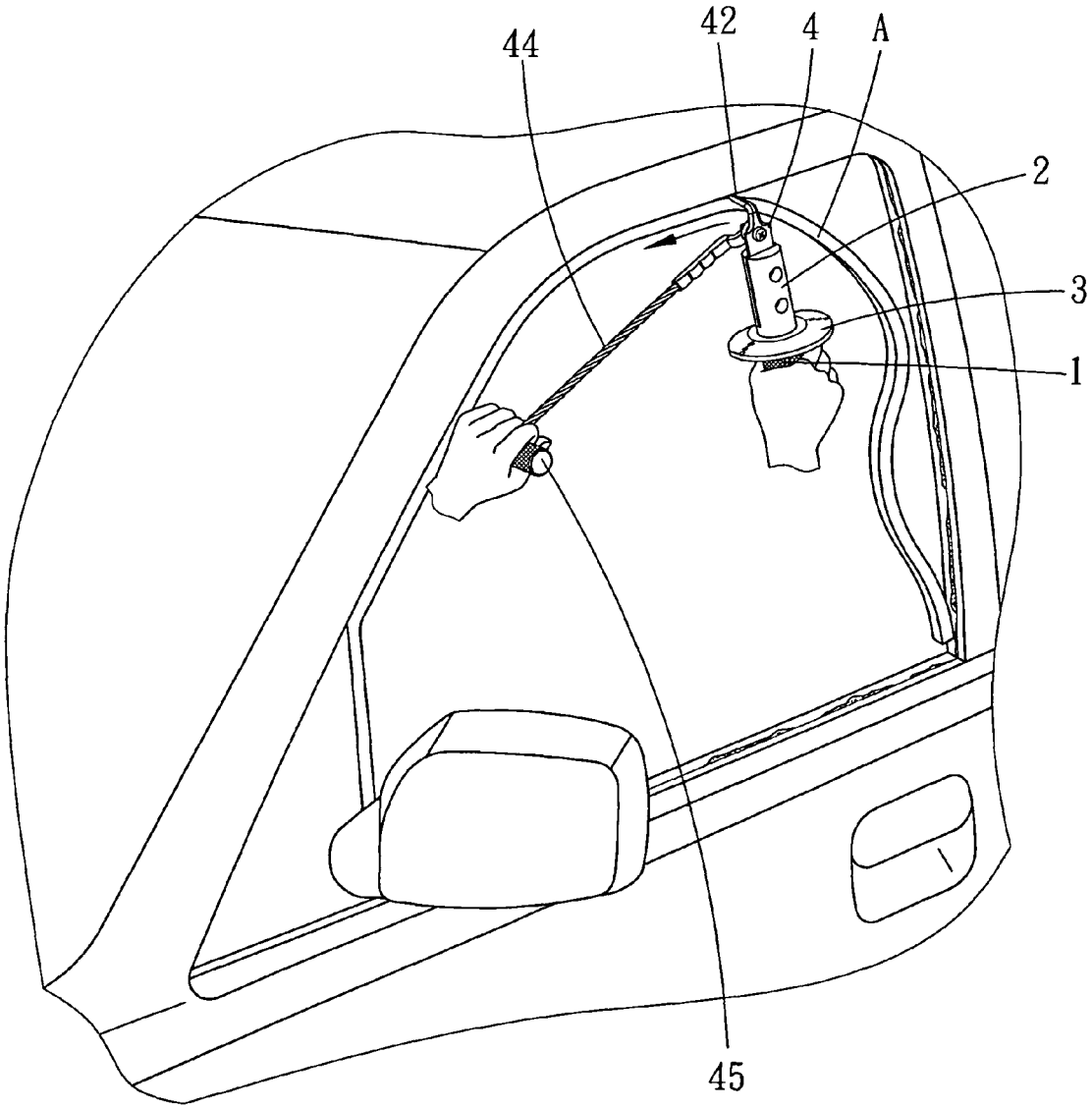
FIG. 5 is a perspective view of the first preferred embodiment of a removing tool for car-window edge strips in the present invention, showing it used for removing car-window edge strips; and, FIG. 6 is perspective view of the second preferred embodiment of a removing tool for car-window edge strips in the present invention, showing it used for scraping car-window edge strips.

In removing car-window edge strips (A), referring to FIG. 5, a user only needs to combine the tool set 4 of the first preferred embodiment with the linking rod 2, as shown in FIG. 2. The tool set 4, as a removing tool, has the auxiliary pull rod 44 pivoted at one side thereof and capable of being received in the shrunk edge 32 of the protective disc 3 that is combined between the grip 1 and the linking rod 2, by which the auxiliary pull rod 44 may rotate for any angle for the convenience of operation. In using, one hand holds the grip 1 to make the blade member 42 insert into the car-window edge strips (A), and the other hand holds and pulls the handle 45 of the auxiliary pull rod 44 outwards, thus the blade member 42 can easily pry off the car-window edge strips (A) by following the movement of the auxiliary pull rod 44, convenient to operate and remove the car-window edge strips (A) with quickness. In addition, the protective disc 3 can protect the user's hand from getting hit during operation.

Figure 6:
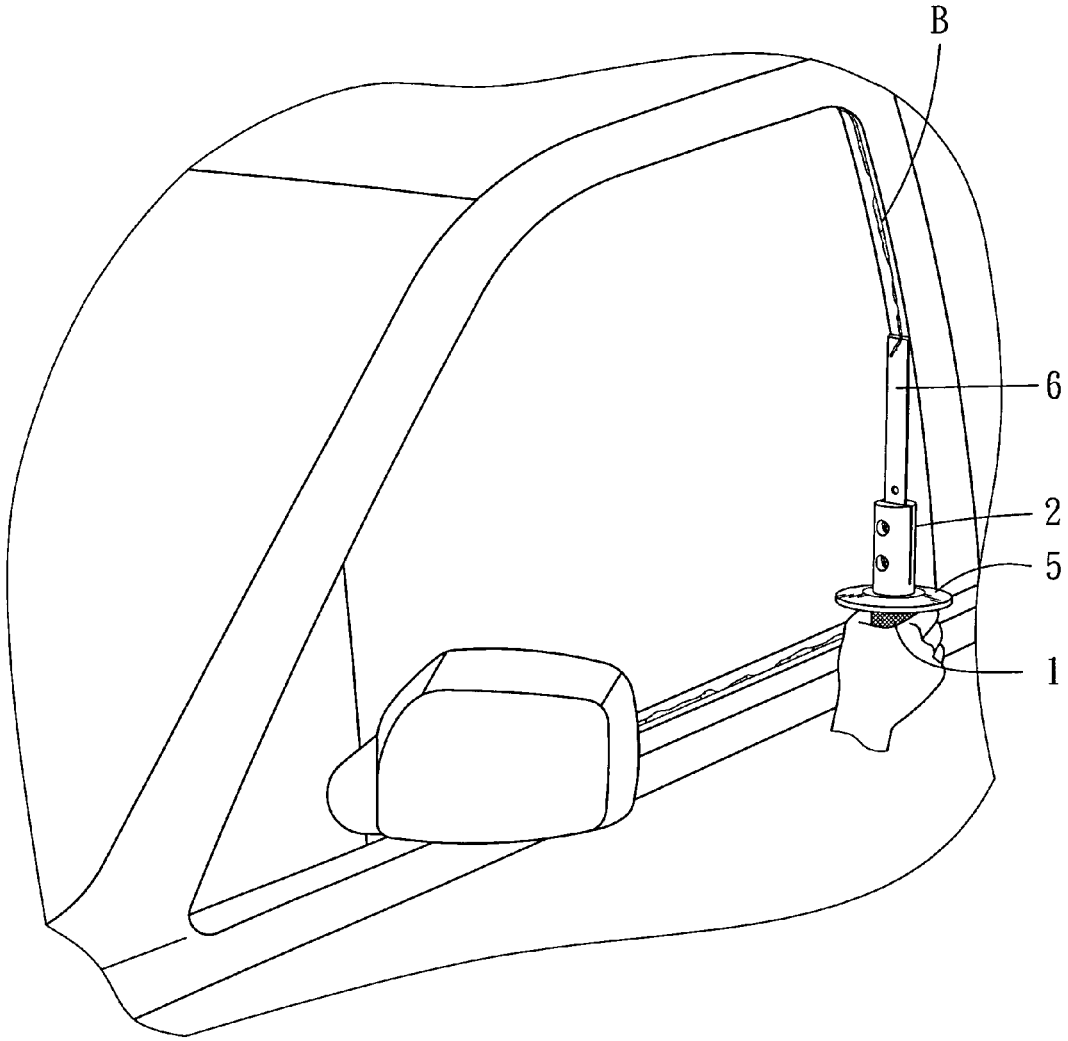

In scraping off dried glue on the car-window edges, referring to FIG. 6, the tool set 4 of the first preferred embodiment used as a removing tool is replaced with the tool set 6 of the second preferred embodiment used as a scraping tool. In replacing, firstly loosen the fixing pin 13 of the grip 1 to rotate and disconnect the linking rod 2 from the grip 1. Secondly, replace the protective disc 3 of the first preferred embodiment with the protective disc 5 of the second preferred embodiment, and then connect the linking rod 2 to the grip 1 again to make the protective disc 5 combined between the grip 1 and the linking rod 2 with the position notch 51 of the protective disc 5 fitting with the position ear 22 of the linking rod 2 to keep the protective disc 5 immovable. Thirdly, tighten the fixing pin 13 of the grip 1 with its inner end pushing tightly against an outer surface of the linking rod 2 to keep the linking rod 2 immovable. Fourthly, loosen the at least one screw 26, and then take the tool set 4 off the linking rod 2. Finally, fit the tool set 6 tightly in the flat insert groove 23 of linking rod 2, and then tighten the at least one screw 26 to the linking rod 2 to make the tool set 6 firmly engaged in the flat insert groove 23 of linking rod 2, finishing changing the tool set 4 to the tool set 6.

In using the second preferred embodiment, referring to FIG. 6, a user holds the grip 1 with one hand, moving and pressing the blade member 61 of the tool set 6 against the upper surface of the dried glue (B) to be removed. Then the blade member 61 can be used to scrap off the dried glue (B), with the protective disc 5 protecting the hand from getting hurt during operation. Thus the linking rod 2 can be combined with different tool sets and their respective protective discs for different purposes.

While the preferred embodiments of the invention have been descried above, it will be recognized and understood that various modifications may be made therein, and the appended claims are intended to cover all such modifications that may fall within the spirit and scope of the invention.

What is claimed is:

1. A removing tool for car-window edge strips comprising:

a grip provided with a recessed chamber, and a female threaded hole formed in a lower portion of said recessed chamber;

a linking rod combined on said grip and provided with a post member at a lower portion thereof, a male threaded rod formed at a lower end of said post member to engage with said female threaded hole of said grip, a flat insert groove formed diametrically in a substantive portion of said linking rod and opening to an upper end, at least one through hole bored in a side of a wall of said linking rod and communicating with said flat insert groove, at least one threaded hole formed in an opposite side of said wall of said linking rod and corresponding to said at least one through hole and communicating with said flat insert groove, and at least one screw respectively passing through said at least one through hole and further engaging with said at least one threaded hole;

a protective disc positioned between said grip and said linking rod and provided with a center hole; and, a tool set combined with said linking rod and having one end fitting in said flat insert groove of said linking rod, at least one through hole bored in said tool set and aligned with said at least one through hole of said linking rod and respectively engaged by said at least one screw of said linking rod.

2. The removing tool for car-window edge strips as claimed in claim 1, wherein said grip has a threaded hole bored near an upper portion of an outer wall thereof and a fixing pin engaged in said threaded hole with its inner end pushing tightly against an outer surface of said post member of said linking rod.

3. The removing tool for car-window edge strips as claimed in claim 1, wherein said post member of said linking rod is provided with a position car on its outer surface, and said protective disc is provided with a position notch in a wall of said center hole for being fitted with said position car of said linking rod therein.

4. The removing tool for car-window edge strips as claimed in claim 1, wherein said protective disc is provided with a shrunk edge.

5. The removing tool for car-window edge strips as claimed in claim 1, wherein said tool set capable of being a removing tool has the other end provided with a blade member extending to bend approximate 90 degrees, and said tool set has one side pivotally connected to an auxiliary pull rod by a pivot, said auxiliary pull rod made of a flexible material and provided with a handle fixed at a lower end thereof.

6. The removing tool for car-window edge strips as claimed in claim 1, wherein said tool set capable of being a scraping tool has the other end provided with a blade member having a sloping surface, and a cover is capable of closing around said blade member.

* * * * *